US006485254B1

(12) United States Patent
Davis

(10) Patent No.: US 6,485,254 B1
(45) Date of Patent: Nov. 26, 2002

(54) ENERGY DISSIPATING COUPLING

(75) Inventor: Matthew Fenton Davis, Brookdale, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/692,902

(22) Filed: Oct. 19, 2000

(51) Int. Cl.[7] ..... F04D 19/04
(52) U.S. Cl. ..... 415/9; 415/90; 285/225
(58) Field of Search ..... 188/371–77; 403/74, 403/89; 285/225; 464/74, 75, 89; 415/9, 90

(56) References Cited

U.S. PATENT DOCUMENTS 4,086,012 A * 4/1978 Buckley et al. ..... 403/2
4,893,857 A * 1/1990 Bobinger et al. ..... 188/371
5,310,030 A * 5/1994 Kawakita et al. ..... 188/371
5,676,421 A * 10/1997 Brodsky
5,943,913 A * 8/1999 Fenelon ..... 464/89
6,145,578 A * 11/2000 Zearbaugh et al.
6,145,586 A * 11/2000 Loker et al. ..... 188/337
6,223,619 B1 * 5/2001 Shibata et al. ..... 188/371
6,332,752 B2 * 12/2001 Ikegami et al. ..... 415/9

* cited by examiner

*Primary Examiner*—Anthony Knight
*Assistant Examiner*—E. Peavey
(74) *Attorney, Agent, or Firm*—Moser, Patterson, Sheridan; Joseph Bach

(57) ABSTRACT

An apparatus and method for coupling a device to a semiconductor processing chamber is provided. The apparatus generally comprises a first ring disposed proximate a second ring. An energy dissipating media is disposed between the first and second rings. Upon the application of a torsional force in excess of a predetermined amount, the first ring rotates relative to the second ring. The energy dissipating media absorbs or dissipates some or all the energy applied to the first and second rings.

31 Claims, 12 Drawing Sheets

ENERGY DISSIPATING COUPLING

BACKGROUND OF THE DISCLOSURE

1. Field of Invention

The present invention relates generally to a semiconductor substrate processing apparatus. More specifically, the invention relates to an apparatus for dissipating energy from a device coupled to semiconductor processing chamber.

2. Background of the Invention

In plasma processing of semiconductor substrates, certain processing steps require the regulation of chamber pressures and removal of gases and process residues from a processing chamber. Typically, pressure regulation and the removal of such gases and process residues are facilitated through the use of a vacuum pumping system and throttle valve coupled to an exhaust port in the processing chamber. Generally, some pumping systems include a large turbomolecular pump.

FIG. 1 depicts an exemplary semiconductor substrate processing system 100 of the prior art having a throttle valve 158 and turbomolecular pump 160. An example of such a chamber is described by Collins in U.S. Pat. No. 5,707,486, issued Jan. 13, 1998.

The processing system 100 comprises a process chamber 110 having a bottom 126, sidewalls 124, and a lid 122 that define a chamber volume 112. A substrate support pedestal 118 is disposed in the process chamber 110 and supports a workpiece or substrate 120 (i.e., a wafer). Generally, at least one gas supply 142 is coupled to the process chamber 110 via one or more ports positioned either in the lid 122 or sidewalls 124. The gas supply 142 provides process and other gases to a processing region 114 of the chamber volume 112 above the substrate 120.

The chamber volume 112 is evacuated via a pumping system 170 coupled to an exhaust port 136 disposed in the sidewall 124 of the process chamber 110. Generally, the pumping system 170 comprises a gate valve 156 and a turbomolecular pump 160. Typically, the gate valve 156 is coupled to the exhaust port 136. The turbomolecular pump 160 is coupled to the gate valve 156. Typically, the gate valve 156 is used to isolate the turbomolecular pump 160 when the pump is not in use. Generally, to reach and maintain processing conditions, the turbomolecular pump 160 is activated to generate and maintain a low or vacuum pressure within the chamber volume 112. Pressure is regulated within the process chamber 110 by actuating a throttle valve 158 disposed between the process chamber 110 and the turbomolecular pump 160, typically at the interface between the process chamber 110 and the exhaust port 136.

As turbomolecular pumps operate at high rotational speeds, the momentum of these devices can be large. When these devices fail, energy is transferred to both the process plumbing and chamber (or intermediate components) to which the pump is mounted. For example, a 2000 liters/second turbomolecular pump used in some processing chambers may generate a deceleration torque of about 60,000 Nm that must be absorbed by the processing chamber if the pump should fail. If this energy is not effectively absorbed by the processing chamber upon pump failure, the chamber to which the pump is mounted may become damaged beyond repair. Chamber failure can result in excessive and costly down time as the failed chamber typically must be removed and replaced by a new chamber. Chamber replacement of this type can result in unplanned loss of factory capacity and late fulfillment of production orders.

Moreover, as higher volume pumps are being developed and utilized in process chambers in order to meet demands for increased wafer throughput, the increased pump energies used to generate the higher flow rates require chambers to be able to absorb even greater amounts of energy in the advent of pump failure. Many existing chambers simply can not accommodate the high energies generated in during pump failure when retrofitted with a higher volume pump.

Therefore, there is a need for an apparatus for coupling a device to a semiconductor processing chamber that can dissipate the energy associated with device failure.

SUMMARY OF INVENTION

An apparatus and method for coupling a device to a processing chamber is provided. Generally, the apparatus comprises a first ring, a second ring, and an energy dissipation ring disposed between the first ring and the second ring. In one embodiment of the invention, the energy dissipation ring deforms when urged against a blade of the first ring when torque in excess of a predetermined amount is applied.

In another embodiment, an apparatus for coupling a device to a processing chamber includes a first ring and an energy dissipation ring disposed proximate the first ring. A loading means biases the device against the energy dissipation ring.

In another aspect of the invention, a method for dissipating rotational energy is disclosed. In one embodiment, the method comprises urging a first ring to rotate relative to a second ring; and deforming a material between the first ring and the second ring to allow rotation.

BRIEF DESCRIPTION OF DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION OF INVENTION

The present invention generally provides an apparatus for coupling a device to a process chamber within a semiconductor substrate processing system. The invention is illustratively described below as upling a device, e.g, a turbomolecular pump, to an etch chamber. However, it should be understood that the description applies to other chamber configurations such as physical vapor deposition chambers, chemical vapor deposition chambers and any other chamber coupled to a device that develops torsional forces that may be desirable to dissipate through controlled rotation.

Figure 1:
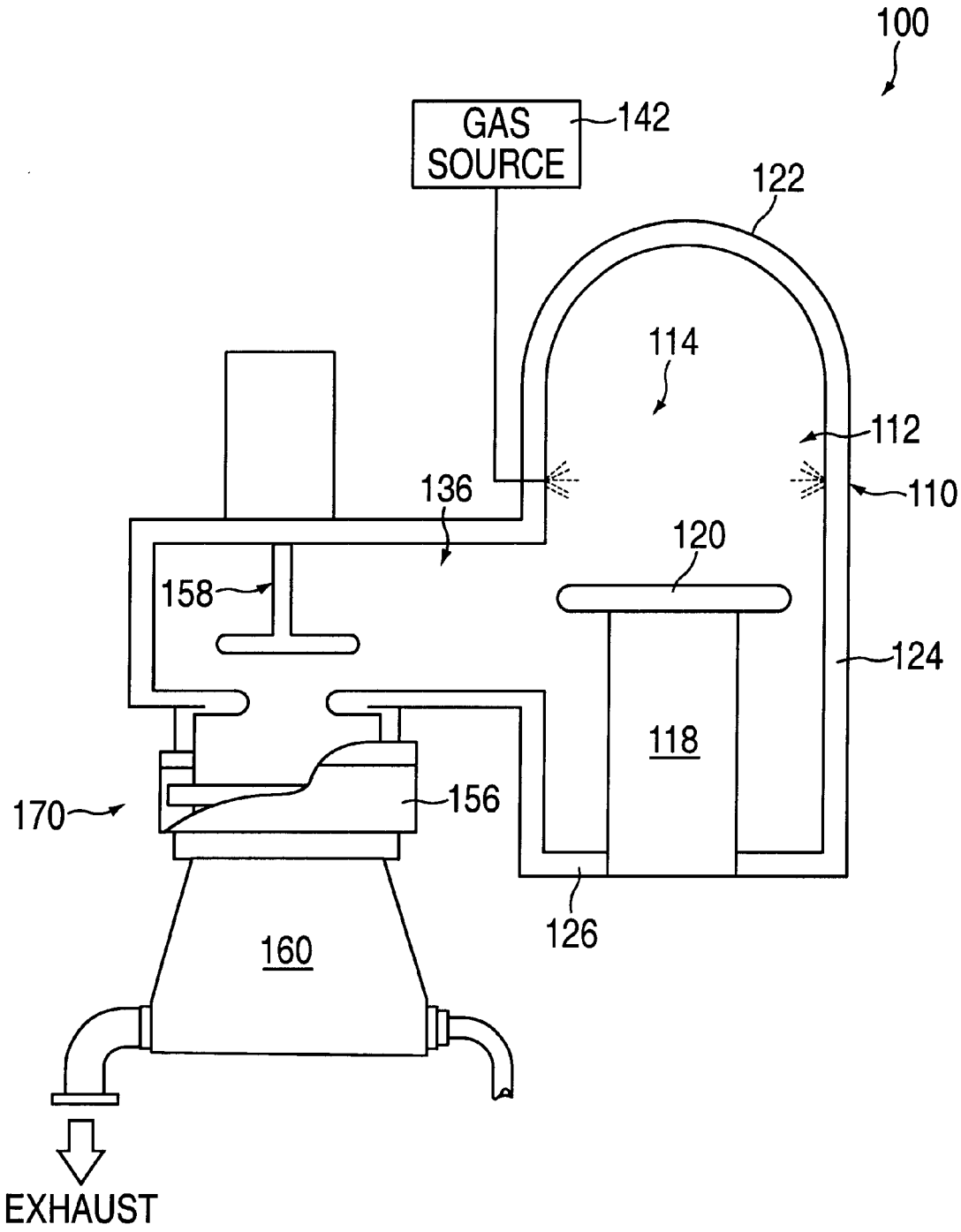
FIG. 1 PRIOR ART
FIG. 1 is a simplified cross-sectional schematic view of a semiconductor substrate processing system of the prior art.
Figure 2:
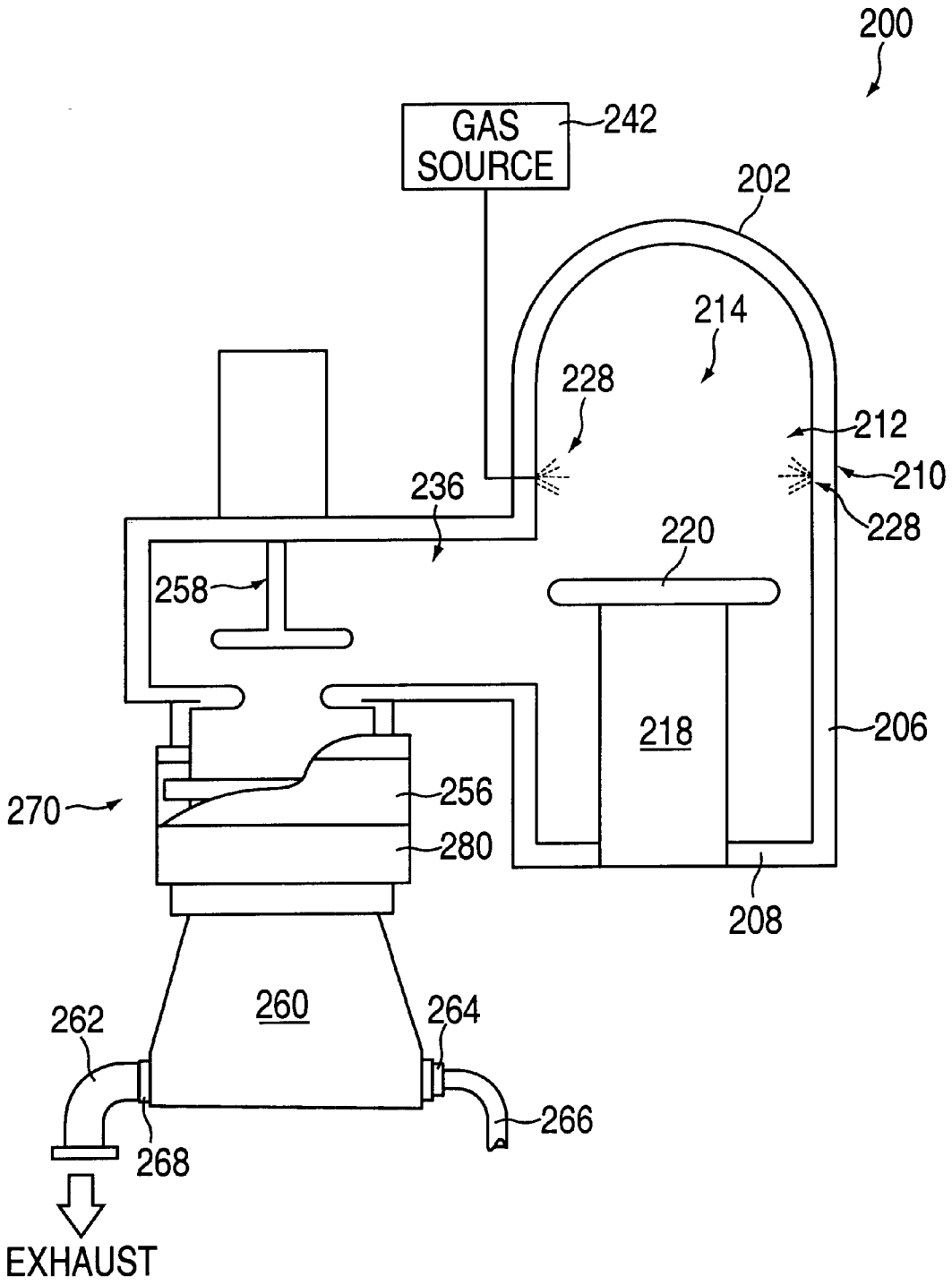
FIG. 2 is a simplified cross-sectional schematic view of a semiconductor substrate processing system having a turbomolecular pump coupled to a process chamber by a energy dissipating coupler.

FIG. 2 is a cross sectional view of one embodiment of a semiconductor processing system 200 of the present invention having an energy dissipating coupling 280 configured as an etch reactor. Optionally, the coupling 280 may be used to couple devices wherein the energy dissipating features of the coupling 280 are not required.

The system 200 generally includes a processing chamber 210, a pumping system 270, and at least one gas source 242. The system 200 comprises additional processing chambers and support devices. The processing chamber 210 an annular sidewall 206, a bottom wall 208, and a domed lid 202 that define a chamber volume 212. A substrate support 218 is centrally disposed in the processing chamber 210. A substrate 220 is positioned upon the substrate support 218 during processing.

The sidewall 206 generally includes an exhaust port 236 and one or more gas inlets 228. The gas inlets 228 generally are coupled to the at least one or more gas sources 242 to provide process and other gases to a processing region 214 of the chamber volume 212. The exhaust port 236 permits excess process gases, volatile compounds produced during processing and other gases to be exhausted from the processing chamber 210 by the pumping system 270.

Generally, the pumping system 270 comprises a gate valve 256 coupled to the exhaust port 236, and the energy dissipating coupling 280 coupled between a turbomolecular pump 260 and the gate valve 256. Typically, the gate valve 256 is used to isolate the turbomolecular pump 260 when the pump is not in use. Generally, to reach and maintain processing conditions, the turbomolecular pump 260 is activated to generate and maintain a low or vacuum pressure within the chamber volume 212. Pressure is regulated within the process chamber 210 by actuating a throttle valve 258 disposed between the process chamber 210 and the turbomolecular pump 260, typically at the interface between the process chamber 210 and the exhaust port 236.

Figure 3:
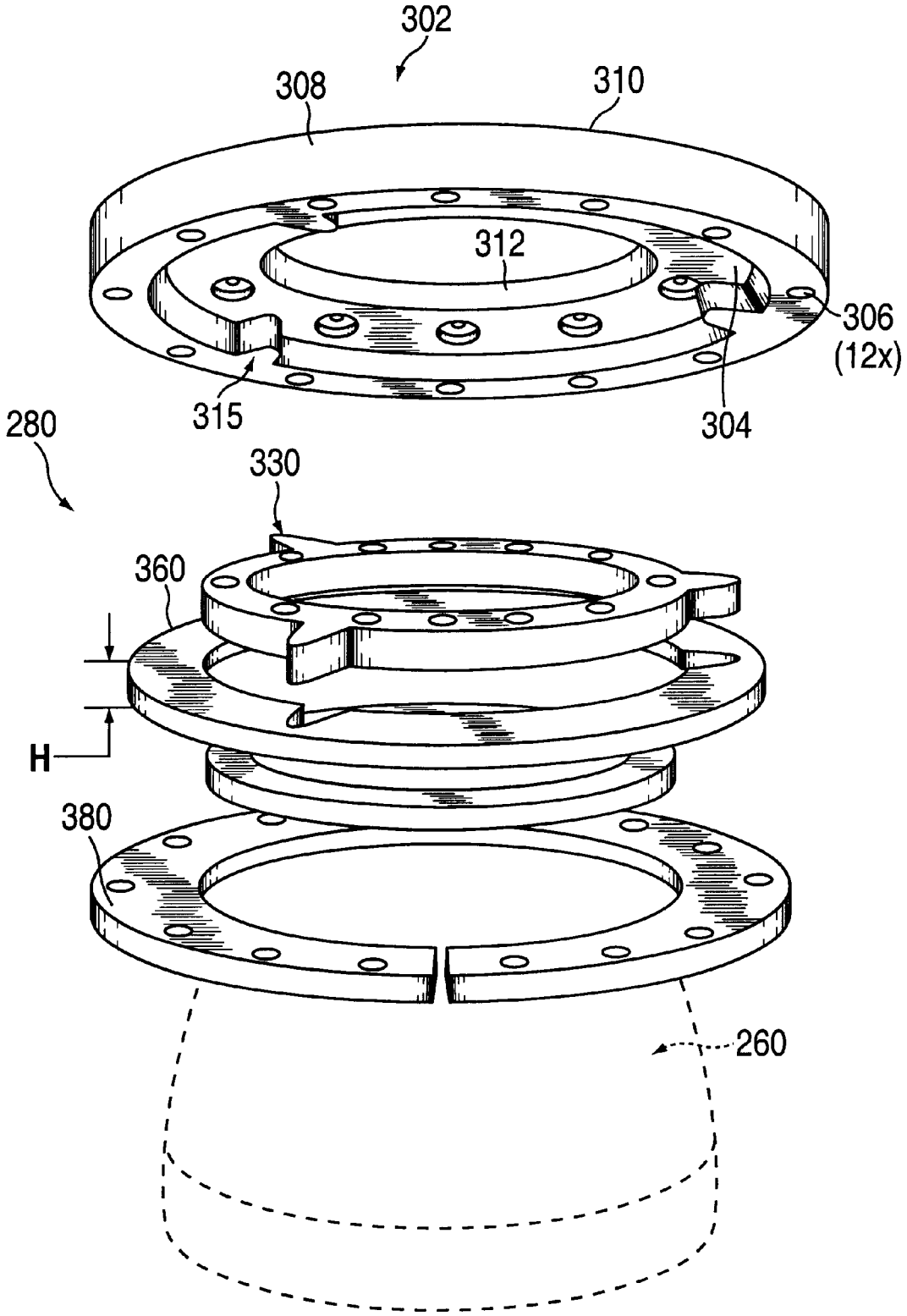
FIG. 3 is an exploded perspective view of the energy dissipating coupler of FIG. 2.
Figure 4:
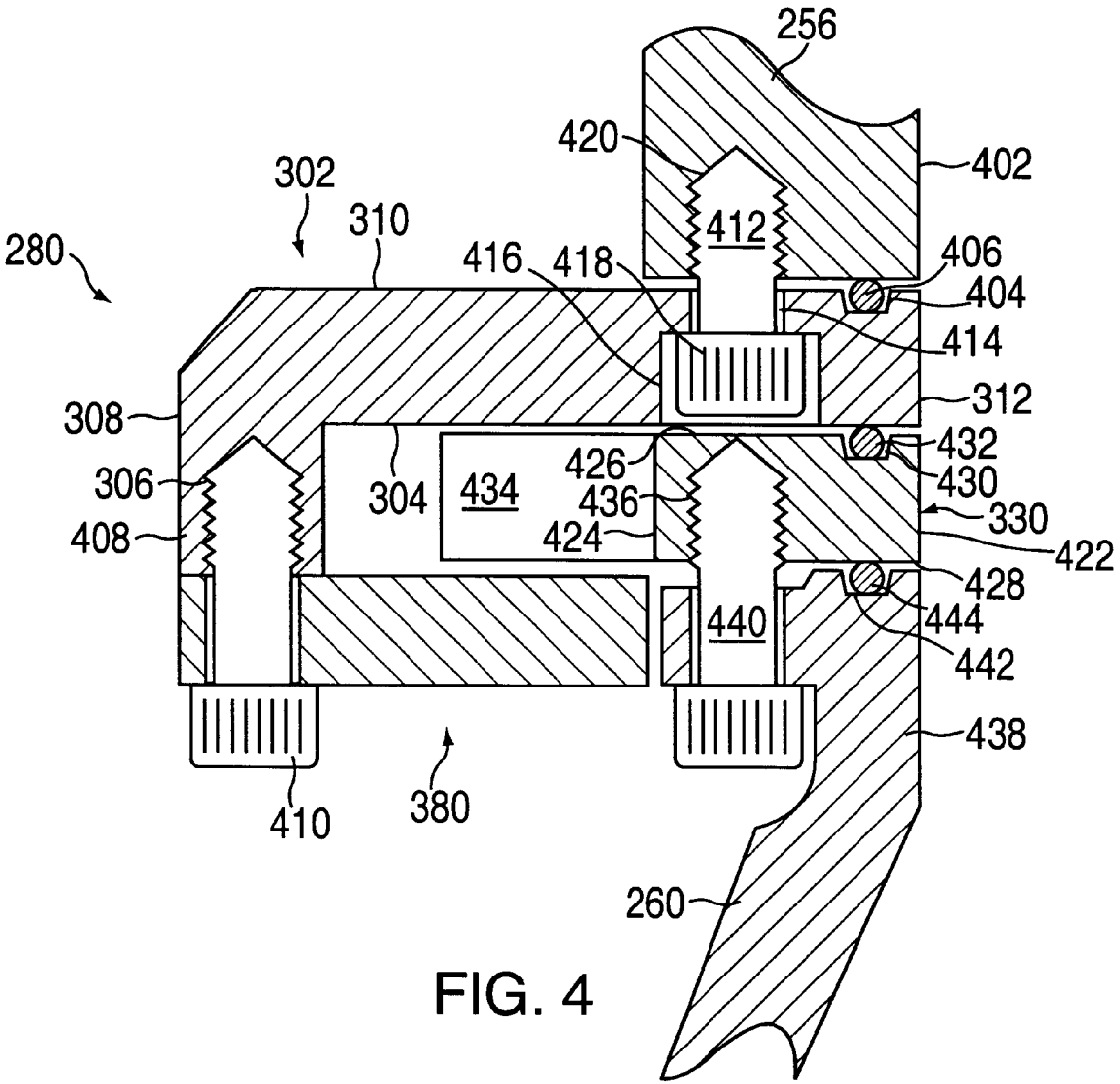
FIG. 4 is a partial sectional view of the energy dissipating coupler of FIG. 2 with an energy dissipating media removed for clarity.

FIGS. 3 and 4 are an exploded, perspective view and a partial sectional view, respectively, of the coupling 280. The coupling 280 is generally comprised of a first ring 302 a second ring 330 and an energy dissipation ring 360 disposed between the first ring 302 and the second ring 330. The first ring 302 and the second ring 330 are generally fabricated from materials compatible with process gases, reaction by-products and other materials typically found in the chamber exhaust. A capture ring 380 is generally fastened to the first ring 302, retaining the second ring 330 and the energy dissipation ring 360 proximate the first ring 302. optionally, the capture ring 380 may be split into two or more sections to facilitate fabrication and assembly of the capture ring 380 to the first ring 302. The capture ring 380 may alternatively provide an inner bearing surface disposed proximate the turbomolecular pump 260 to maintain in a co-axial orientation with the first ring 302 in the advent of rotation by the turbomolecular pump 260. Generally, since first ring 302 and capture ring 380 rotate relative to the second ring 330, ring materials should be selected to prevent gauling. In one embodiment, the first ring 302, second ring 330, and the capture ring 380 are electropolished stainless steel.

The first ring 302 is generally annular in shape having a first face 304, an opposing second face 310, an outside diameter 308 and an inside diameter 312. The inside diameter 312 is generally configured to match an inside diameter 402 of the gate valve 256 as not to produce a flow restriction. The first face 304 includes an o-ring groove 404 proximate the inside diameter 312 provided to receive an o-ring 406.

The second face 304 includes mounting lip 408 extending coaxially to the inner diameter 312 outwards from the second face 304 at the outer diameter 308. The mounting lip 408 includes a first plurality of threaded mounting holes 306 to which the capture ring 380 is fastened. In one embodiment, the capture ring 380 is fastened to the mounting lip 408 by twelve mounting MIO high strength socket head cap screws 410 mating with the mounting hole 306 positioned in a spaced apart relation about the mounting lip 408 on a bolt circle.

A plurality of blades 315 (three blades are shown) extend outwards from the second surface 304 less than or equal to the distance of the mounting lip 408 projects from the second surface 304. Generally, the blades 315 may take any number of geometric forms. In the embodiment shown, the blades 315 are triangular in shape, having one point positioned towards the inner diameter 312 and a base coupled to the mounting lip 408. The blades 315 are generally spaced 120 degrees from each other.

The first ring 302 is coupled to the gate valve 256 via a plurality of bolts 412 passing through a corresponding clearance hole 414 in the first ring 302. The bolts 412 generally are positioned on in a spaced apart relation about a bolt circle matching a bolt-hole pattern in a mounting flange 438 of the turbomolecular pump 260. The bolts 412 are positioned radially outwards of the o-ring 406 to maintain the integrity of the seal between the first ring 302 and the gate valve 256. A head 418 of the bolts 412 is recessed in a counter bore 416 provided in the second surface 304. In one embodiment, the first ring 302 is fastened by twelve 10M high strength socket head cap screws 412 mating with threaded hole 420 in the gate valve 256.

The second ring 330 is generally co-axial to the first ring 302 and is disposed in the area defined by the first face 314 and the mounting lip 408 of the first ring 302 and the capture ring 380. The second ring 330 is generally annular in shape and has an inner diameter 422, an outside diameter 424, a first face 426 and an opposing second face 428. The inner diameter 422 is generally configured to match the inside diameter 312 of the first ring 302 and the inside diameter 402 of the gate valve 256 as not to produce a flow restriction. The first face 426 includes an o-ring groove 430 proximate the inner diameter 422 provided to receive an o-ring 432.

The second face 428 has a plurality of threaded holes 436 positioned to accept mounting bolts 440 that fastens the flange 438 of the turbomolecular pump 260 to the second ring 330. Generally, the flange 438 of the turbomolecular pump 260 contains an o-ring groove 442 that accommodates an o-ring 444 disposed to seal the turbomolecular pump 438 to the second ring 330.

The second ring 330 has a plurality of blades 434 (three are shown) projecting outwardly from the outside diameter 424. Generally, the blades 434 may take any number of geometric forms. In the embodiment shown, the blades 434 are triangular in shape, having one point positioned outwardly from the second ring 330 with the base coupled to the outside diameter 424. The blades 434 are spaced 120 degrees from each other.

Figure 5:
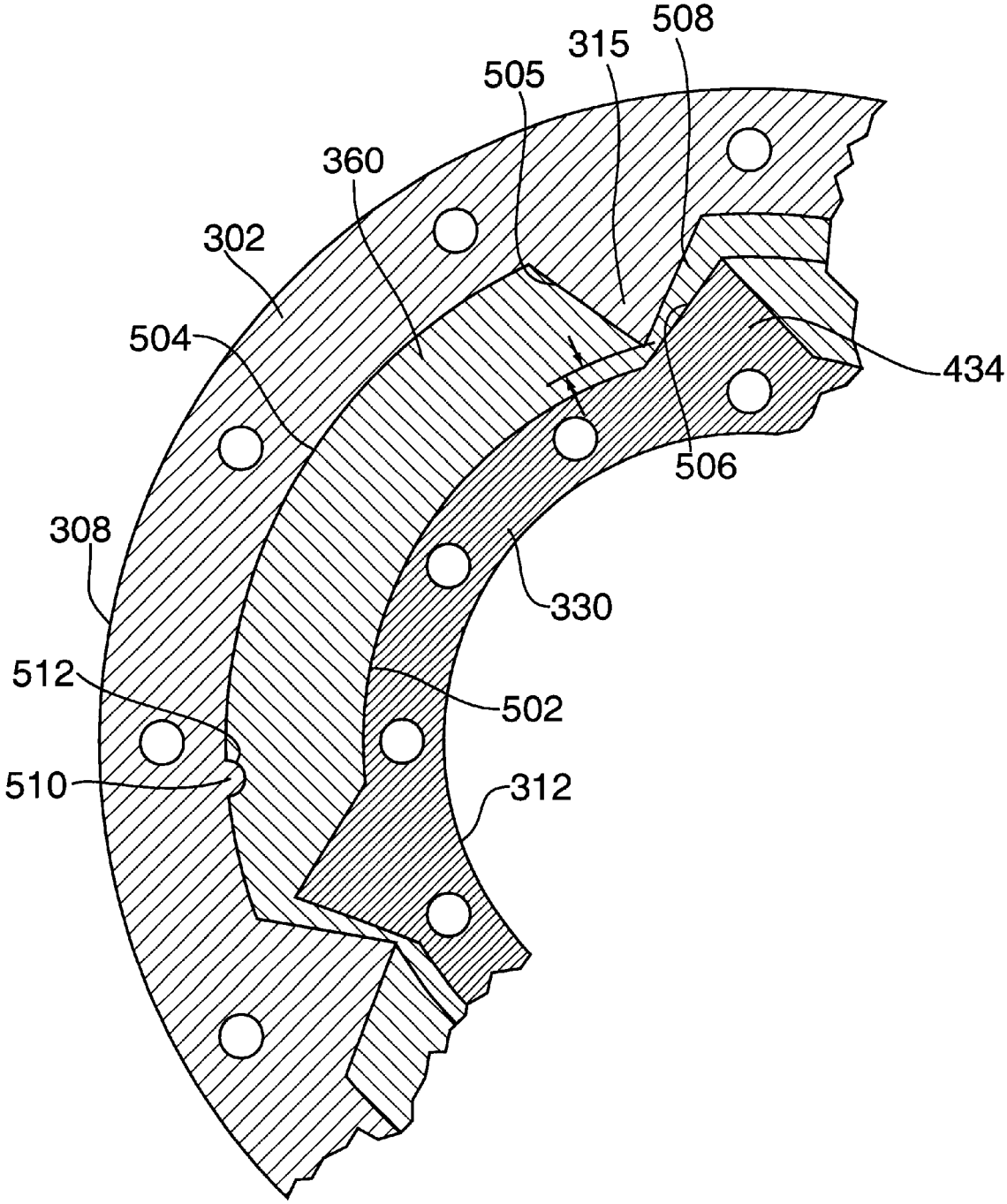
FIG. 5 is a partial sectional view of the energy dissipating coupler of FIG. 2.

Referring to FIGS. 3 and 5, the energy dissipation ring 360 is disposed between the first ring 302 and the second ring 330. Generally, the energy dissipation ring 360 is annular in form, and is fabricated from a largely inelastic polymer or material, for example, fluoropolymers (such as Teflon®), soft metals (such as lead), thickened gel, polymer foam and the like. The energy dissipation ring 360 has a inner diameter 502 and an outer diameter 504. The outer diameter 504 has a plurality of first recesses 505 configured to accommodate each blade 315 of the first ring 302. The size and location of the recesses 505 is predicated upon the number, geometry and position of the blades 315 relative the first ring 302. Similarly, a second plurality of recesses 506 provided about the inner diameter 502 are configured to accommodate each blade 434 of the second ring 330. Generally, the position of the first recesses is offset relative the second recesses such that a band 508 of ring material keeps the energy dissipation ring 360 in one piece.

As the second ring 330 rotates counter-clockwise in the event of turbomolecular pump 260 failure, care must be taken in installing the energy dissipation ring 360 such that the first recesses 505 are to the left of the band 508 when looking down at the turbomolecular pump 260. This will ensure approximately 120 degrees rotation of the first ring 302 relative the second ring 330, allowing the energy to be dissipated as the blades 315 and 330 cause the energy dissipation ring material to deform and flow around the blades. Optionally, a locating device 510, such as a notch, tab, pin, or other locating feature may be offset to one side of a blade on either the first ring 302 or the second ring 330. The locating device 510, illustratively shown as a tab disposed on the first ring 302, interfaces with a mating feature 512 in the energy dissipation ring 380 such as to ensure the proper orientation of the blades of the first ring 302 relative the blades of the second ring 330.

Figure 6:
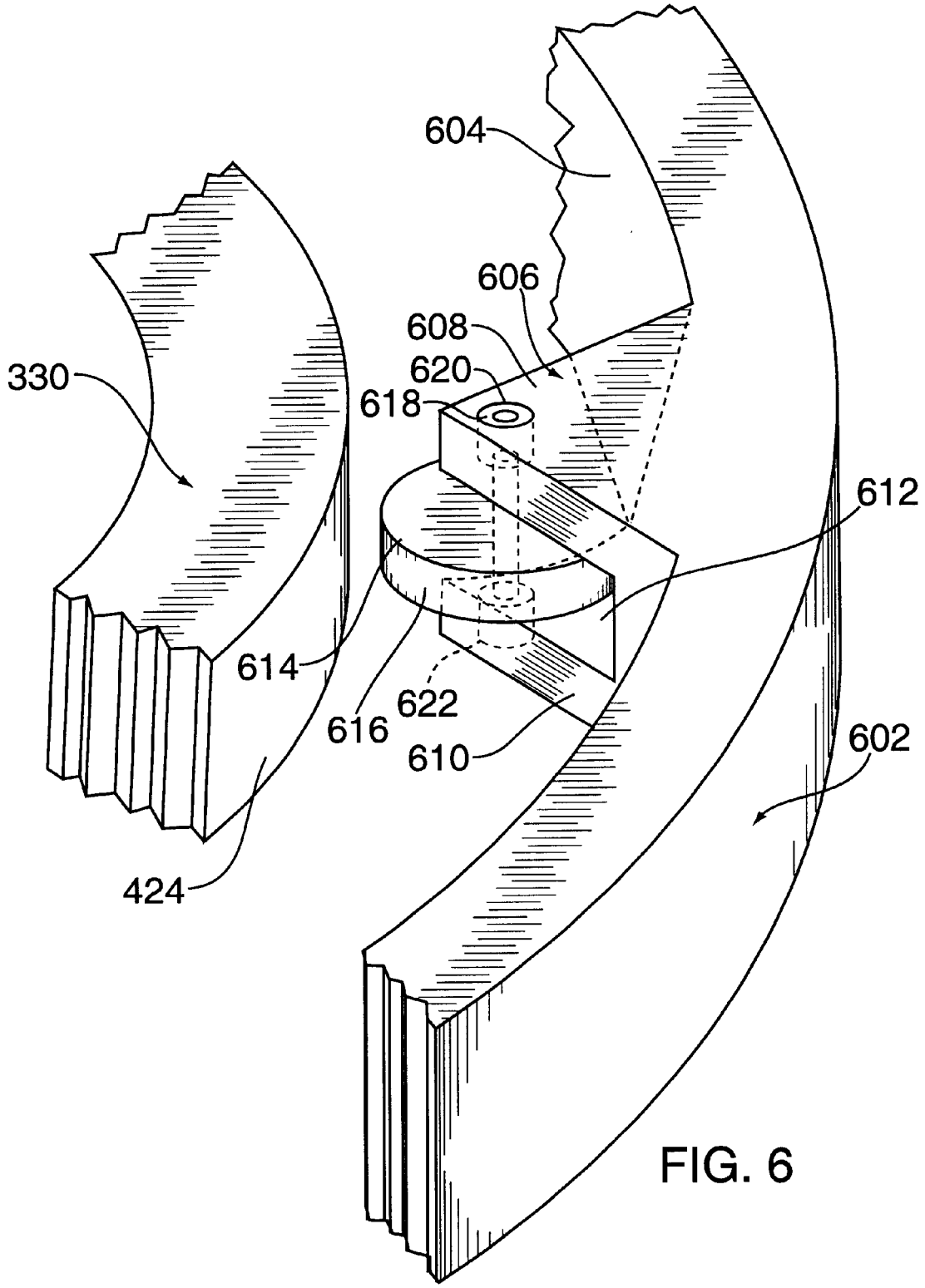
FIG. 6 is a sectional view of another embodiment of an energy dissipating coupler.

FIG. 6 depicts an alternative embodiment of a first ring 602 having a bearing 614 disposed between the first ring 602 and the second ring 330. The bearings 614 maintain the first ring 302 and the second ring 330 co-axially aligned during rotational motion between the first ring 602 and second ring 330. In one embodiment, the first ring 602 has an inner diameter 604 from which one or more blades 606 outwardly protrude. The blade 606 includes a first section 608 and a second section 610 that define a slot 612 therebetween. The first section 608 includes a counter-sunk hole 620 for receiving a bolt 618. The bolt 618 passes through the center of the bearing 614 disposed in the slot 612 and threads into a mating hole 622 disposed in the second section 610, thus retaining the bearing 614 within the slot.

The bearing 614 have an outer perimeter 616 that maintains a concentric orientation of the first ring 602 and the second ring 330 in the advent of relative motion between the rings. Optionally, the bearings may be disposed on the blades of the second ring 330, or on both the first ring 602 and second ring 330.

Referring to FIGS. 2 and 5, in operation, the substrate 220 is placed on the wafer support 218 and the processing chamber 210 is evacuated by the pumping system 270. Typically, the evacuation of the processing chamber 210 and subsequent control of the process and other gases is performed using the throttle valve 258 in conjunction with the turbomolecular pump 260 using a method commonly practiced in the art.

In the event of failure of the turbomolecular pump 260, the turbomolecular pump 260 may generate torque up to and exceeding 60,000 Nm (when using a 2000 1/sec pump). As the torque increases, the second ring 330 is urged into motion by the decelerating turbomolecular pump 260. Generally, break-away couplings 264 and 268 are provided between the electrical and exhaust lines 266 and 262, respectfully, to allow the pump 260 to rotate. As the torque exceeds a predetermined value known as the "break-away torque", the second ring 330 and turbomolecular pump 260 begin to rotate relative the first ring 302. In one embodiment, the break away torque is about 1500 foot-lbs. Once the second ring 330 begins to rotate, the blades 434 compress the energy dissipating media 360 against the blades 315, and deform (e.g., extrude) the energy dissipating media 360 in a viscous flow between the blades 315, 434, and the opposing rings 302, 330. As the energy dissipating media is extruded over the blades 315, 434, the coupling 280 dissipates the energy that the turbomolecular pump 260 applies to the system 200 after the pump failure.

Since both the break-away torque and dissipation energy vary with both the turbomolecular pump or other force generating object having energy which may be dissipated through rotational motion and the relative geometry of these devices, the components and their interrelations may be described by the following example.

Fluid flow for some materials, for example polymers, such as polytetrafluoroethylene (PTFE), occurs above a critical shear stress $\tau_c$ at a rate proportional to a viscosity $\mu$. These are suitable media for energy absorption. For the coupler geometry in which each energy dissipating cell has the equivalent geometry, the velocity profile (at ambient temperature) may be expressed as:

$$V = \frac{\partial v}{\partial \eta} \tag{1}$$

where:

v is linear velocity of the second ring 330, and n is gap between the blades 315, 434 and the opposing rings 302, 330.

Taking Newton's viscosity law and substituting $\tau_c$ for $\tau$, a relation between a media dependent parameter and an application dependent parameter may be established as follows:

$$\tau = \mu \frac{\partial V}{\partial \eta} \Rightarrow \mu = \frac{\tau}{\frac{\partial V}{\partial \eta}} \tag{2}$$

$$\frac{\partial v}{\partial \eta} = \frac{V}{(g-h)} \tag{3}$$

$$\frac{(g-h)}{V} = \frac{\partial v}{\partial \eta} \tag{4}$$

$$\frac{(g-h)}{V} = \frac{\mu}{\tau_c} \tag{5}$$

where:

g is the distance between the first ring and the second ring;

h is the height of the constriction in ring gap "g" to resist fluid flow;

v is the initial velocity of the rotor including a reasonable factor of safety, for example about 1.0 to about 3.5;

$$\frac{(g-h)}{V}$$

is the application dependent parameter; and $\mu\tau_c$ is the media dependent parameter.

The term (g-h) depends upon the space available in the coupler balanced by the choice of media and the initial V of the turbomolecular pump. Thus, (g) and (h) must be selected to match the flow characteristics of a chosen media and the desired rate of energy absorption.

The initial velocity V may be determined by taking the torque of the pump and subtracting the counter-torque of the coupler to yield a net torque. The net torque is converted into a force by multiplying the net torque by a mean radius of the blades. The force is divided by the effective mass of the pump to yield acceleration. The acceleration is multiplied by crash duration to yield V.

The effective mass of the pump is related to its moment of inertia by mV=I[dw/dt], where I=moment of inertia of the pump, [dw/dt]= angular velocity (in radians/second), and V= tangential velocity (in units of distance/second) of the pump evaluated at the mean radius of the blades. The moment of inertia I of a pump is a parameter available from the manufacturer.

The maximum initial velocity $V_{max}$ is dictated by the maximum travel, the maximum torque that can be transmitted to the chamber and the mass of the pump.

$V_{max}$ may be calculated by taking a design counter-torque $T_c$ and dividing by the mean blade radius to yield a tangential counter-force $F_c$. $T_c$ may be expressed as:

$$T_c=T_{max}/FS \tag{6}$$

where:

$T_{max}$ is the maximum sustainable torque to the chamber; and

FS is a reasonable factor of safety, for example 2.0.

Once $F_c$ is determined, acceleration is calculated by dividing $F_c$ by the effective mass of the pump. A time t may be resolved by taking distance d, expressed as $d=(½)\ At^2$, where d equals the circumferential distance traveled by the blade (for example, 100 degrees of rotation at a 14 in mean blade diameter is equivalent to a circumferential distance traveled of $\pi$ (14)*(100/360)=12.21 in), and solving for t. Once time t has been obtained, $V_{max}$ may be resolved by multiplying the acceleration by time t.

If $V>V_{max}$ then the design will not dissipate the force generated by the pump failure and another configuration must be utilized. For example, variables such as radius, media, area may be altered, or another configuration may be utilized, for example a configuration as embodied in FIG. 7.

Figure 7:
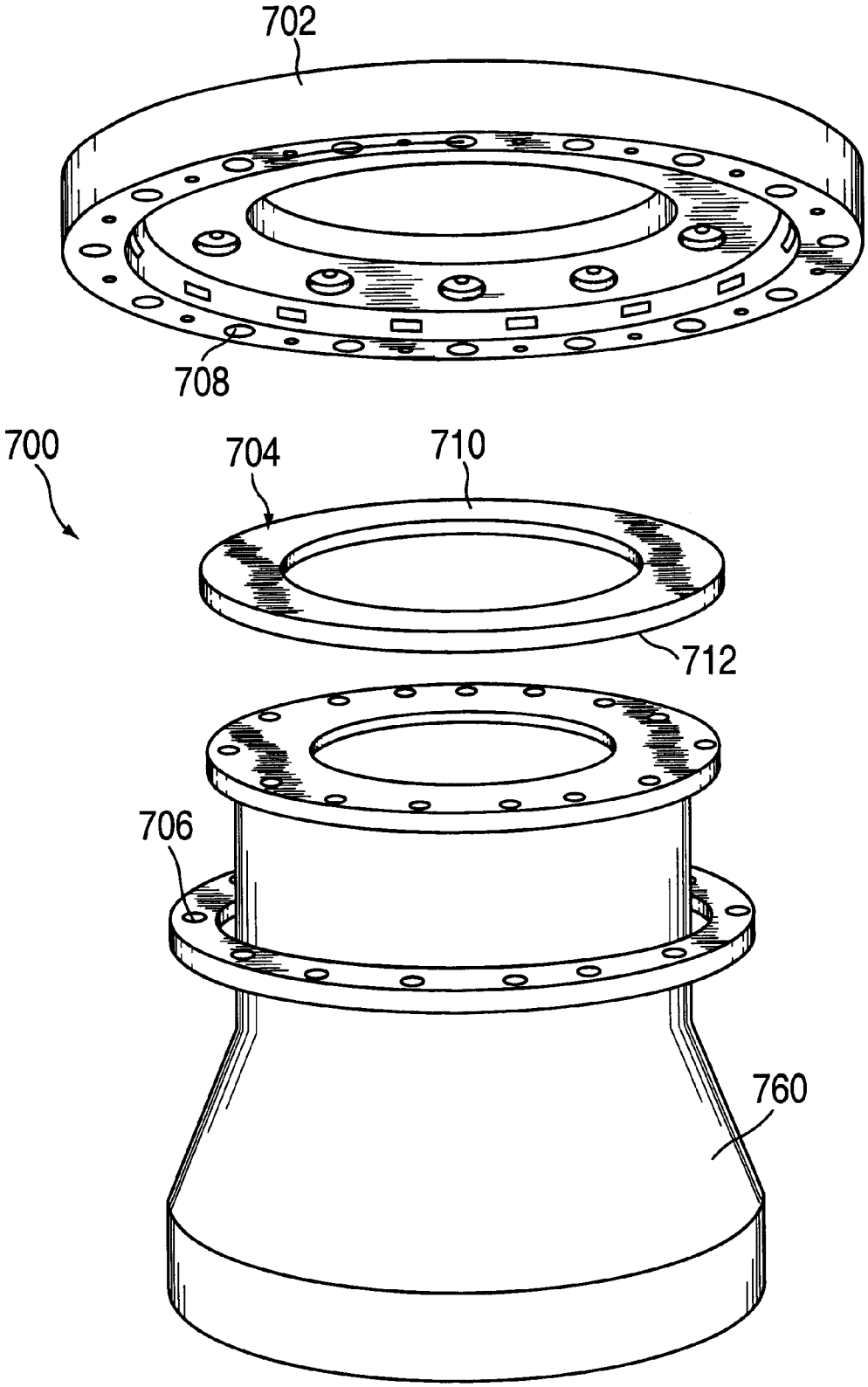
FIG. 7 is a sectional view of another embodiment of an energy dissipating coupler.

FIG. 7 depicts another embodiment of an energy dissipating coupling 700. The energy dissipating coupling 700 generally comprises a first ring 702 and a second ring 706, with an energy dissipation ring 704 disposed between the first ring 702 and the second ring 706. The first ring 702 is generally fabricated from materials compatible with process gases, reaction by-products and other materials typically found in the chamber exhaust. Generally, since first ring 702 rotates relative a turbomolecular pump 260 in the advent of pump failure, the material of the first ring 702 should be selected to prevent galling with the turbomolecular pump 260. In one embodiment, the first ring 702 is electropolished stainless steel.

The energy dissipation ring 704 is annular in form, and is comprises a first bearing surface 710 and a second bearing surface 712. The bearing surfaces 710, 712 generally interfaces with the first ring 702 and the turbomolecular pump 260, respectively, and generate sufficient frictional force to dissipate the energy generated by failure of the turbomolecular pump 260. Static friction between the first ring 702, turbomolecular pump 260 and energy dissipation ring 704 is high enough to insure that rotation of the turbomolecular pump 260 relative the first ring 702 does not occur during normal operation. Typically, bearing surfaces 710, 712 of the energy dissipation ring 704 are comprised of a sintered material such as bronze. Optionally, the entire energy dissipation ring 704 may be comprised of sintered bronze. Alternatively, the energy dissipation ring 704 may be integral to (i.e., be part of or fixed to) the first ring 702.

Figure 8:
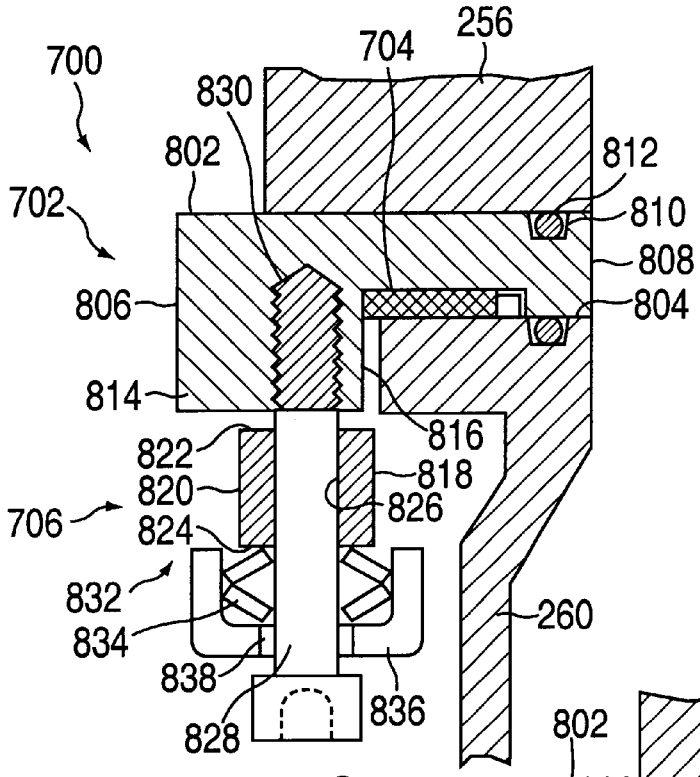
FIG. 8 is a sectional view of another embodiment of an energy dissipating coupler.
Figure 9:
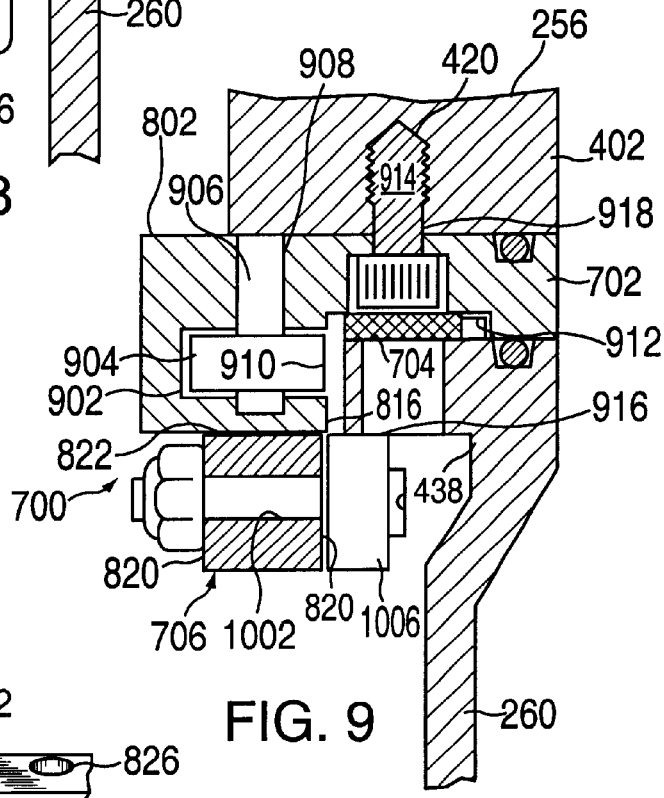

FIGS. 8 and 9 depict the energy dissipating coupling 700 in greater detail. FIG. 8 depicts a partial sectional view taken passing radially through the center of one of a plurality of retainer mating holes 708 in the first ring 702 of FIG. 7. FIG. 9 depicts a partial sectional view taken passing radially through one of a plurality of bearings in the first ring 702 of FIG. 7.

The first ring 702 is generally annular in shape having a first face 802, an opposing second face 804, an outside diameter 806 and an inside diameter 808. The inside diameter 808 is generally configured to match an inside diameter 402 of the gate valve 256 as not to produce a flow restriction. The first face 802 includes an o-ring groove 810 proximate the inside diameter 808 provided to receive an o-ring 812.

The second face 804 includes mounting lip 814 extending co-axially to the inner diameter 808 outwards from the second face 804 at the outer diameter 806. The mounting lip 814 includes the plurality of threaded mounting holes 830 spaced apart on a bolt circle. The mounting lip 814 has an inside surface 816 concentric with the inside diameter 808. A plurality of slots 902 are disposed about the inside surface 816. The slots 902 are configured to partially house a bearing 904.

The bearing 904 is retained in the slot 902 by a dowel pin 906 that passes through a hole 908 that is intersected by the slot 902. The hole 908 enters the first ring 702 from the first face 802 as to allow the dowel pin 906 to be installed. The bearing 904, which may be a roller or solid bearing, has a perimeter 910 that extends beyond the inside surface 816 such as to maintain the turbomolecular pump 260 concentrically aligned with the first plate 702 during rotation of the turbomolecular pump 260 in the advent of pump failure.

The second face 804 additionally comprises a recess 912 proximate the inside wall 816 to accommodate the energy dissipation ring 704. The recess 912 is configured such that the energy dissipation ring 704, when disposed in the recess 912, extends beyond the second face 804 by about 0.010 inches.

The first ring 702 is coupled to the gate valve 256 via a plurality of bolts 914 passing through a corresponding clearance hole 918 in the first ring 702. The hole 918 is counter-sunk at the recess 912 such that the head of the bolts 914 do not extend into the recess 912. The bolts 412 generally are positioned in a spaced apart relation about a bolt circle matching a bolt-hole pattern in the mounting flange 438 of the turbomolecular pump 260. The bolts 412 are positioned radially outwards of the o-ring 406 to maintain the integrity of the seal between the first ring 302 and the gate valve 256. In one embodiment, the first ring 702 is fastened by twelve 12 mm high strength socket head cap screws 914 mating with threaded hole 420 in the gate valve 256.

The second ring 706 is annular in form and is fabricated from a material suitable for handling the stresses generated as discussed below. In one embodiment, the second ring 706 is stainless steel.

The second ring 706 has an inner diameter 818, an outer diameter 820, a first face 822 and a second face 824. The second ring 706 includes a plurality of through holes 826 that extend between the first face 822 and the second face 824. Generally, the holes 826 are configured as clearance hole to accept a socket drive shoulder screw 828 that threads into the mating threaded hole 830 disposed in the mounting lip 814 of the first ring 702.

Figure 10:
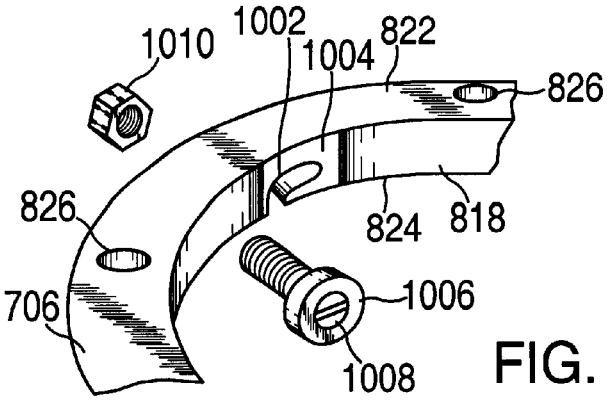

Referring additionally to FIG. 10, the second ring 702 also includes a plurality of slots 1002 connecting the inner diameter 818 and the outer diameter 820. The slots 1002 are positioned typically between the through holes 826. Each slot 1002 is generally open to one face of the second ring 702, and in one embodiment, is open to the second face 824. The inner diameter 818 has a flat 1004 formed perpendicular to the radius of the second ring 706 that permits a bearing 1006 that is fasten to the slot 1002 by a bolt 1008 and lock nut 1010, to rotate freely without binding against the second ring 706. The position of the slot 1002 relative the first face 822 and diameter of the bearing 1002 is such that a perimeter 916 of the bearing 1006 extends beyond the first face 822 of the second ring 706. The bearing 1006 may be either a roller or solid bearing.

Referring back to FIGS. 8 and 9, the energy dissipating coupling 700 includes a loading means 832. The loading means 832 provides a bias force that urges the second ring 706 towards the first ring 702. The bias force is transferred through the bearing 1006 of the second ring 706 to the flange 438 of the turbomolecular pump 260. The flange 438 is correspondingly urged by the bias force against the energy dissipation ring 704. The bias force, along with the frictional characteristics of the bearing surfaces, effects the static friction and energy dissipation features of the coupling 700.

In one embodiment, the loading means 832 includes a loading device 834 and a retainer 836. The retainer 836 has an aperture 838 through which the shoulder screw 828 passes. The shoulder screw 828, when installed, causes the retainer 836 to compress the loading device 834 to generate the bias force. The loading device 834 may comprise one or more elastic members, coil springs, flat springs, belleville washers, other like energy storing devices or combinations thereof. In one embodiment, the loading device 834 comprises a plurality of belleville washers disposed on twelve shoulder screws 828, wherein the loading device generates bias force in excess of 5000 pounds.

Alternatively, the energy dissipative features of the coupling 700 may be described in terms of the geometry and physical parameters of the coupling. For example, the relation between the width of the energy dissipation ring 704 and the bias force provided by the loading means 832 may be expressed by:

$$\tau_B = F_B r \tag{7}$$

$$F_B = F_N \tag{8}$$

and substituting equation (7) into equation (8);

$$\tau_B = F_N r/\mu \tag{9}$$

where:

$\mu$ is the coefficient of friction between the energy dissipation ring 704 and the component sliding thereon (such as the pump 260);

$\tau$ is the break torque;

$F_B$ is the tangential break force; and $F_N$ is the normal or bias force applied by the loading means 832.

Equation (9) may be expressed in terms of $F_N$ as:

$$F_N = \tau_B \mu/r \tag{10}$$

Since the normal force may be described in terms of force per unit area, assuming a design criteria $PSI_{CRITICAL}$ for loading of the energy contact ring (the maximum loading of the material divided by a reasonable factor of safety), the geometry of the energy dissipation ring 704 can be expressed in terms of the normal force as:

$$PSI_{CRITICAL} \geqq F_N/A \tag{11}$$

where:

A is the contact area of the energy dissipation ring 704. Since the contact area may be expressed as:

$$A \approx 2\pi rw \tag{12}$$

where:

W is the width of the contact area of the energy dissipation ring;

$$PSI_{CRITICAL} \geqq F_N/2rw \tag{13}$$

or $$rw \geqq F_N/2\pi PSI_{CRITICAL} \tag{13}$$

The term (rw) represents the geometry of the energy dissipation ring 704 expressed in terms of the normal force applied by the loading means 832 ($F_N$).

Figure 11:
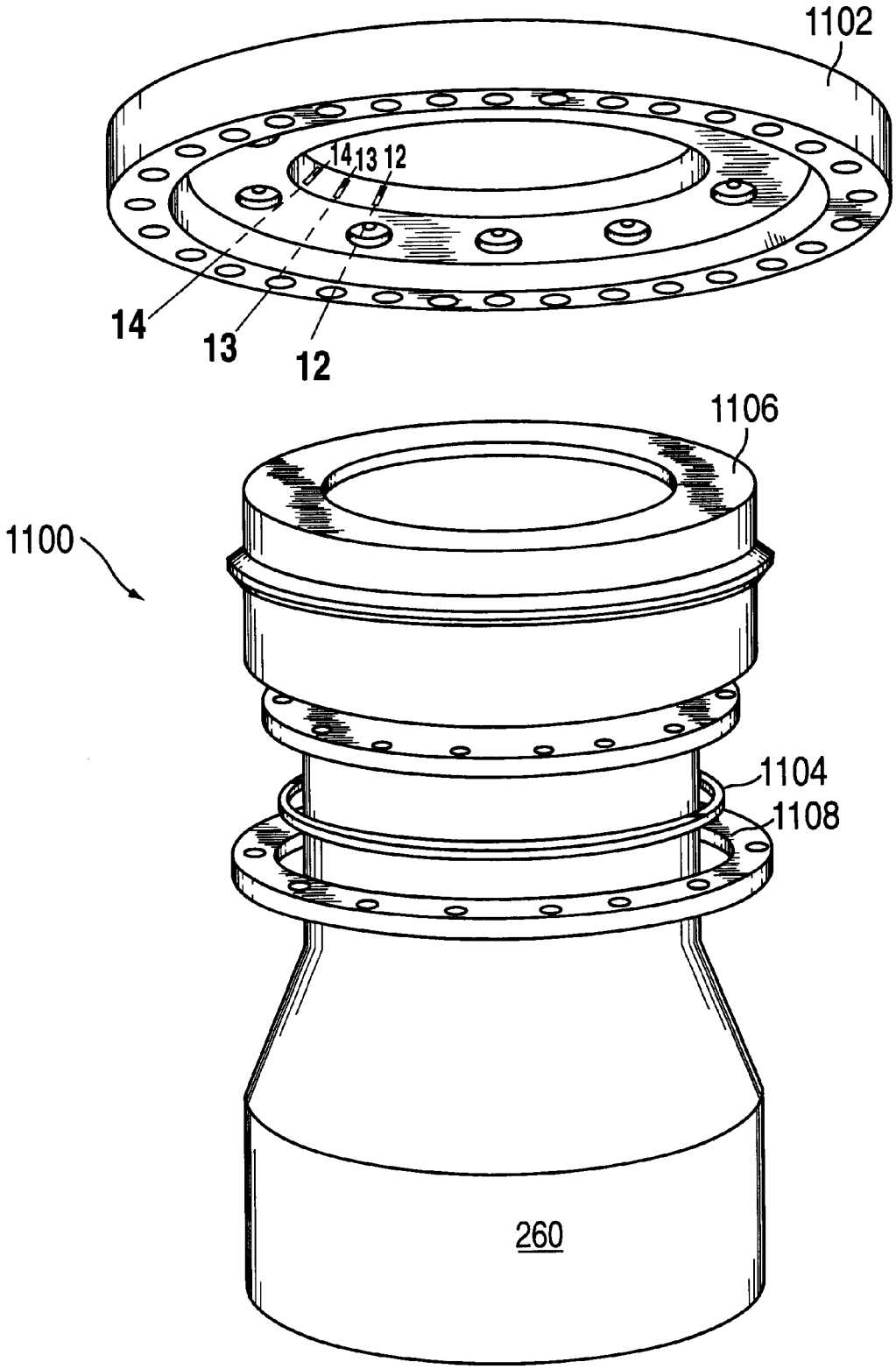

FIG. 11 depicts an another embodiment of an energy dissipating coupling 1100. The energy dissipating coupling 1100 provides the dissipation of rotational energy through friction similarly as described with reference to the coupling 700 of FIG. 7. The energy dissipating coupling 1100 generally comprises a first ring 1102 coupled to a retaining ring 1108 that retains a second ring 1106, proximate the first ring 1102 with an energy dissipation ring 1104 disposed between the retaining ring 1108 and the second ring 1106. The first ring 1102 and the second ring 1106 are generally fabricated from materials compatible with process gases, reaction by-products and other materials typically found in the chamber exhaust. Generally, since first ring 1102 rotates relative the second ring 1106 in the advent of failure by the turbomolecular pump 260 coupled to the second ring 1106, the material of the first ring 1102 and the second ring 1106 should be selected to prevent galling. In one embodiment, the first ring 1102 and the second ring 1106 are electropolished stainless steel.

Figure 12:
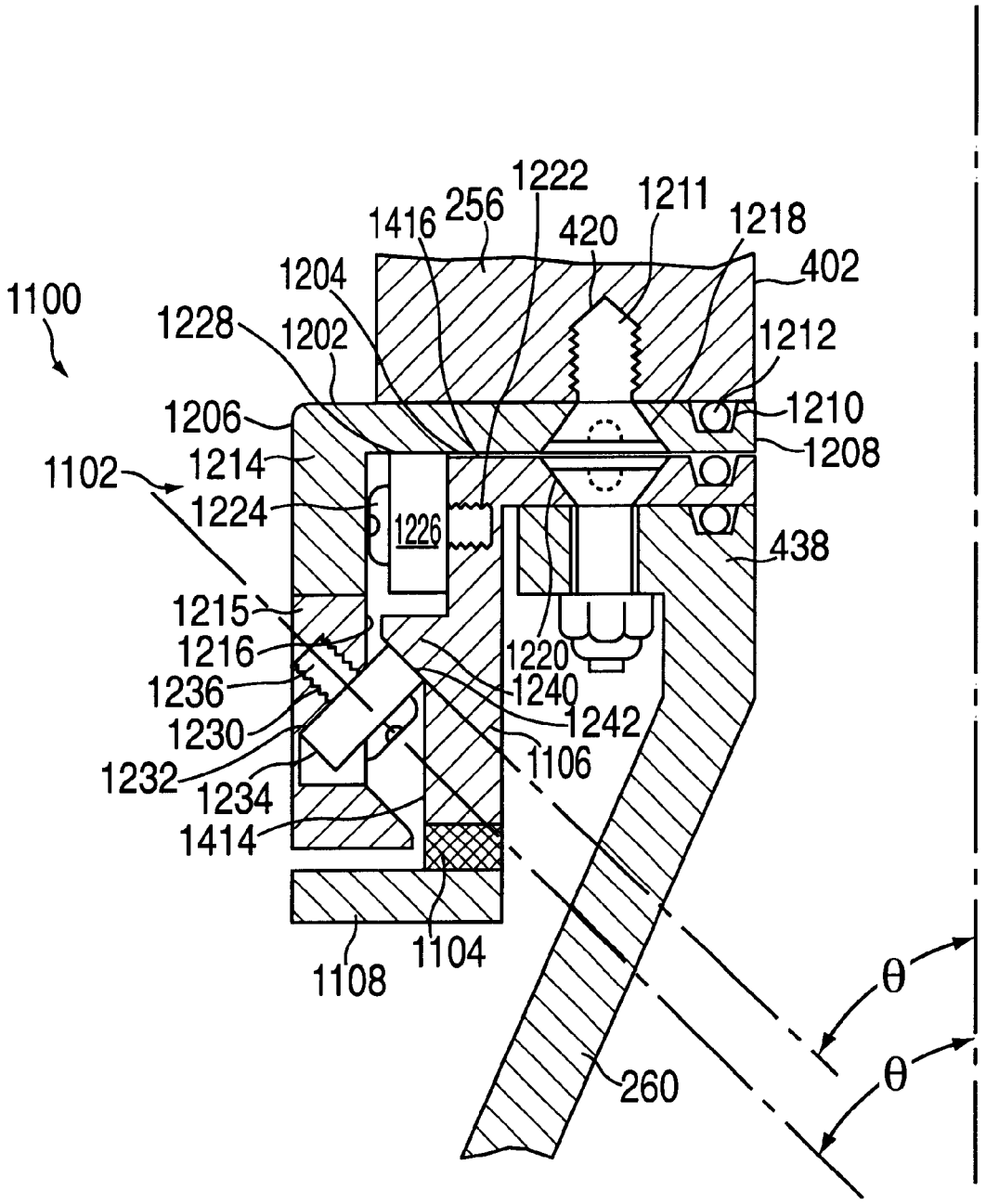
Figure 13:
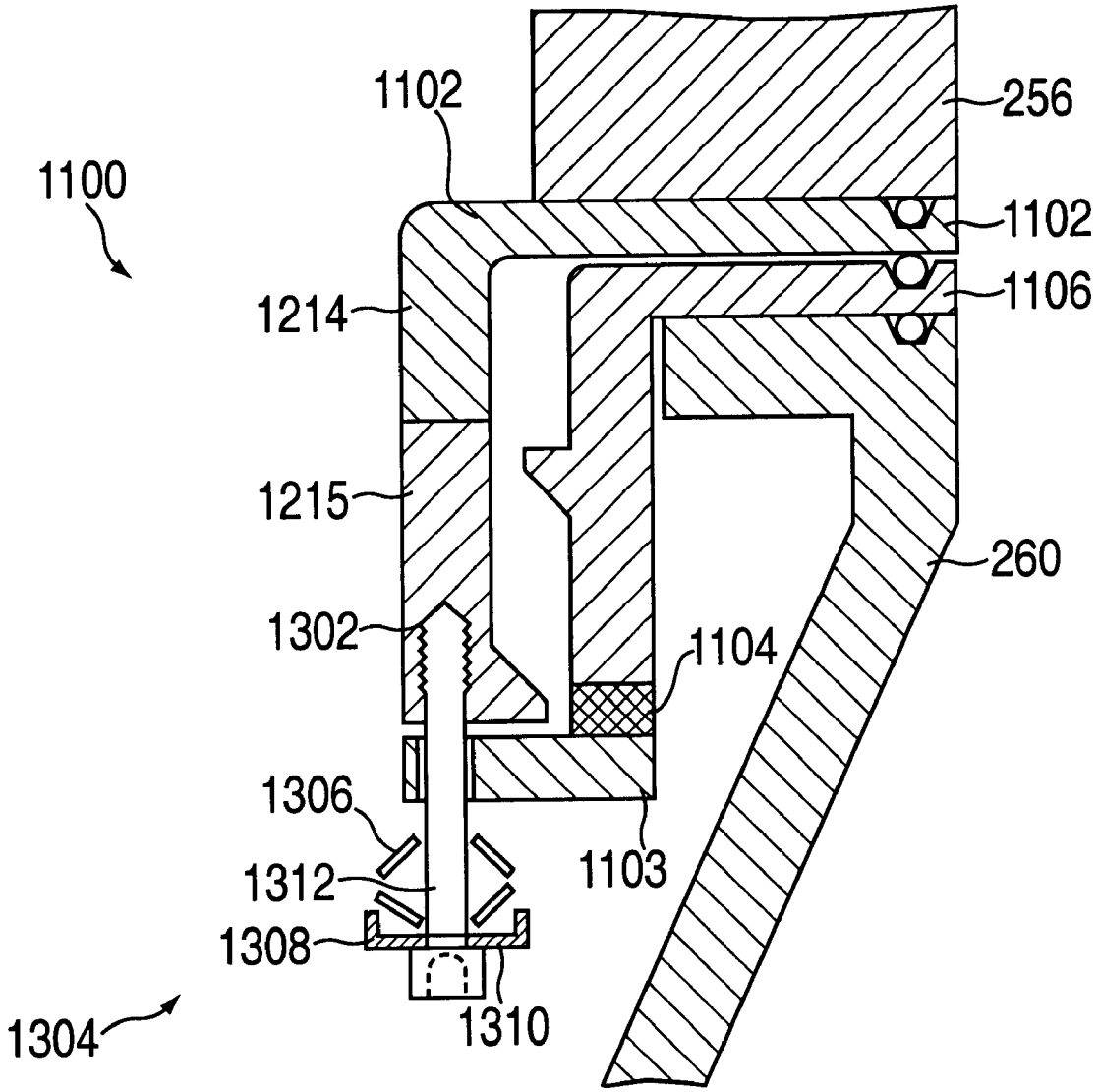
Figure 14:
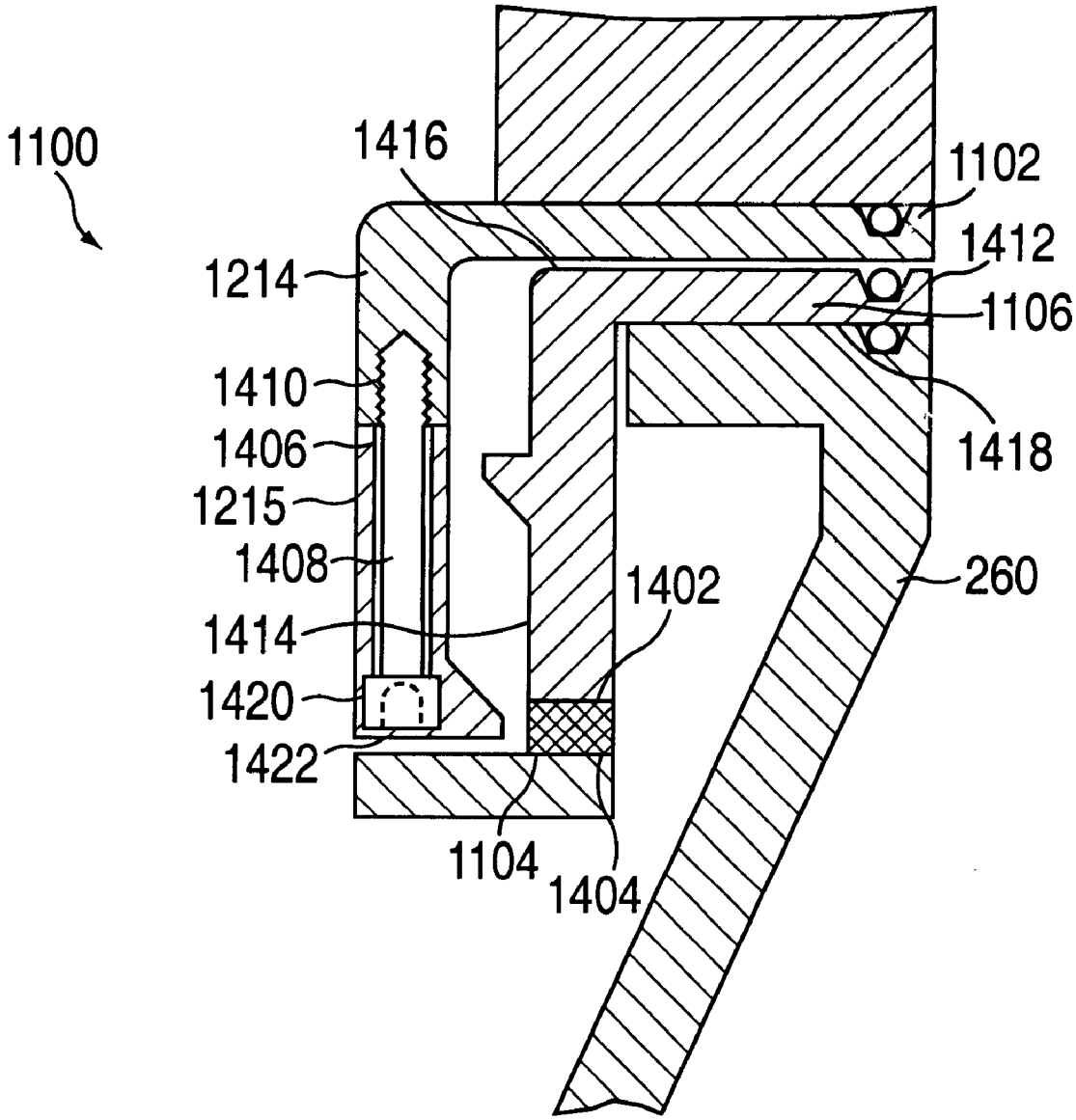

The energy dissipating coupling 1100 can be understood in greater detail by referring to partial sectional views depicted in FIGS. 12, 13 and 14. The energy dissipation ring 1104 is annular in form and comprises a first bearing surface 1402 and a second bearing surface 1404. The bearing surfaces 1402, 1404 generally interfaces with the second ring 1106 and the retainer ring 1108, respectively, and generate adequate frictional force to dissipate the energy generated by failure of the turbomolecular pump 260. Static friction between the second ring 1106 retaining ring 1108 and energy dissipation ring 1104 is high enough to insure that no rotation of the turbomolecular pump 260 relative the first ring 1102 occurs during normal operation. Typically, bearing surfaces 1402, 1404 of the energy dissipation ring 1104 are comprised of a sintered material, such as bronze. Alternatively, the entire energy dissipation ring 1104 may be comprised of sintered bronze.

The first ring 1102 comprises is generally annular in shape having a first face 1202, an opposing second face 1204, an outside diameter 1206 and an inside diameter 1208. The inside diameter 1208 is generally configured to match an inside diameter 402 of the gate valve 256 as not to produce a flow restriction. The first face 1202 includes an o-ring groove 1210 proximate the inside diameter 1208 provided to receive an o-ring 1212.

The second face 1204 includes mounting lip 1214 extending co-axially to the inner diameter 1208 outwards from the second face 1204 at the outer diameter 1206. The mounting lip 1214 includes an extension 1215. The extension 1215 may be an integral part of the lip 1214, or a separate piece that is secured to the lip 1214.

The extension 1215 has an inner diameter 1216 that includes a plurality of threaded holes 1230. The threaded holes 1230 are at an angle θ to a centerline $C_L$ of the coupling 1100. The angle θ is generally in the range of about 30 to about 60 degrees. Each threaded hole 1230 includes a counter bore 1232 or other undercut that permits a bearing 1234 to be mounted to the extension 1215 by a screw 1236. Generally, the bearing 1234 is a roller or solid bearing.

The extension 1215 additionally includes a plurality of threaded holes 1302 and a plurality of through holes 1406. Generally, the extension 1215 is coupled to the mounting lip 1214 by threading a bolt 1408, passing through each of the holes 1406 into a mating threaded hole 1410 disposed in the mounting lip 1214.

The extension 1215 is mounted to the first ring 1102 by a plurality of mounting screws 1408. The mounting screws 1408 pass through a clearance hole 1406 in the extension 1215 and thread into a threaded hole 1410 in the lip 1214. The clearance hole 1416 includes a counter bore 1420 that permits the head of the screw 1408 to be below an end 1422 of the extension 1215.

The first ring 1102 is coupled to the gate valve 256 via a plurality of bolts 1211 passing through a corresponding hole 1218 in the first ring 1102. The hole 1218 has a counter bore or counter-sink on the second face 1204 such that the head of the bolts 1211 does not extend beyond the second face 1204. The bolts 1211 generally are positioned in a spaced apart relation about a bolt circle matching a bolt-hole pattern in the gate valve 256. The bolts 1211 are positioned radially outwards of the o-ring 1212 to maintain the integrity of the seal between the first ring 1202 and the gate valve 256. In one embodiment, the first ring 1102 is fastened by twelve 12 mm high strength socket head cap screws 1211 mating with threaded hole 420 in the gate valve 256.

The second ring 1106 has an inner diameter 1412, an outer diameter 1414, a first face 1416 and a second face 1418. The second ring 1106 includes a plurality of through holes 1220 that extend between the first face 1416 and the second face 1418. The hole 1218 has a counter bore or counter-sink on the second face 1204 such that the head of the bolts 1211 does not extend into the second face 1204. The bolts 1211 generally are positioned in a spaced apart relation about a bolt circle matching a bolt-hole pattern in the gate valve 256. The bolts 1211 are positioned radially outwards of the o-ring 1212 to maintain the integrity of the seal between the first ring 1202 and the gate valve 256. In one embodiment, the first ring 1102 is fastened by twelve 12 mm high strength socket head cap screws 1211 mating with threaded hole 420 in the gate valve 256.

The second ring 1102 has a projection 1240 extending from the outer diameter 1414. The projection 1240 includes a face 1242 that is orientated at the angle θ to the centerline $C_L$ of the coupling 1100. The face 1242 provides a bearing surface upon which the bearing 1234 travels in the event that the second ring 1106 rotates in relation to the first ring 1106. The bearing 1234 and face 1242 maintains the turbomolecular pump 260 concentrically aligned with the first ring 1102 during rotation of the turbomolecular pump 260 due to pump failure.

The second ring 1102 also includes a plurality of threaded holes 1222 in the outer diameter 1414. Each of the threaded holes 1222 accepts a bolt 1224 that couples a bearing 1226 to the second ring 1106. The position of the threaded holes 1222 relative the first face 1416 and diameter of the bearing 1226 is such that a perimeter 1228 of the bearing 1226 extends beyond the first face 1416 of the second ring 1106. The bearing 1226 may be either a roller or solid bearing.

The energy dissipating coupling 1100 includes a loading means 1304. The loading means 1304 provides a bias force that urges the retaining ring 1108 against the energy dissipation ring 1104. The energy dissipation ring 1104 transfers this force to the second ring 1106 and urges the second ring 1106 towards the first ring 1102.

In one embodiment, the loading means 1304 includes a loading device 1306 and a retainer 1308. The retainer 1308 has an aperture 1310 through which the shoulder screw 1312 passes. The shoulder screw 1312, when installed, causes the retainer 1308 to compress the loading device 1306 to generate the bias force. The loading device 1306 may comprise one or more elastic members, coil springs, flat springs, belleville washers, other like energy storing devices or combinations thereof. In one embodiment, the loading device 1306 comprises a plurality of belleville washers disposed on twelve shoulder screws 1312, wherein the loading device generates bias force in excess of 5000 pounds.

Although the embodiment of the invention which incorporate the teachings of the present invention which has been shown and described in detail herein, those skilled in the art can readily devise other varied embodiments which still incorporate the teachings and do not depart from the spirit of the invention.

What is claimed is:

1. Apparatus for coupling a device to a processing chamber comprising:

a first ring;

a second ring adapted to rotate relative to the first ring;

an energy dissipation ring disposed between said first ring and said second ring; and a turbomolecular pump coupled to said second ring.

2. The apparatus of claim 1, wherein the first ring further comprises:

one or more blades projecting from said first ring.

3. The apparatus of claim 2, wherein said blade further comprises:

a bearing disposed thereon.

4. The apparatus of claim 2, wherein said energy dissipation ring further comprises:

an outer diameter having one or more recesses that interface with said one or more blades.

5. The apparatus of claim 2, wherein the relation between the geometry of the first ring, the second ring and the energy dissipation ring may be expressed as:

$$\frac{(g-h)}{V} = \frac{\mu}{\tau_c}$$

where:

g is the distance between the first ring and the second ring;

h is the gap between the blade and the opposing ring through with the energy dissipation ring flows;

V is the initial velocity of the first ring including a factor of safety between 0.0 to about 3.5;

$\tau_c$ is the critical shear stress of the energy dissipation ring; and $\mu$ is the viscosity of the energy dissipation ring.

6. The apparatus of claim 1, wherein said first ring comprises:

a retaining ring coupled to said first ring, said retaining ring having at least a portion of said energy dissipation ring disposed between said first ring and said retaining ring.

7. The apparatus of claim 1, wherein said second ring comprises:

one or more blades projecting from said second ring.

8. The apparatus of claim 7, wherein said energy dissipation ring further comprises:

one or more recesses that accommodate said one or more blades of said second ring.

9. The apparatus of claim 1 further comprising:

a bearing disposed between said first ring and said second ring, said bearing maintaining said first and said second rings concentrically aligned.

10. The apparatus of claim 1 further comprising:

a retaining ring coupled to said first ring, said retaining ring capturing said second ring.

11. The apparatus of claim 1, wherein the energy dissipation ring deforms when the first ring rotates relative the second ring.

12. The apparatus of claim 11, wherein the rotation begins when torque greater than about 1500 foot-lbs is applied between the first ring and the second ring.

13. The apparatus of claim 1, wherein the energy dissipation ring is plastic.

14. The apparatus of claim 1, wherein the energy dissipation ring is a fluoropolymer.

15. The apparatus of claim 1 further comprising:

a first seal disposed between the first ring and the energy dissipation ring; and a second seal disposed between the second ring and the energy dissipation ring.

16. The apparatus of claim 1 further comprising:

a loading means for urging the second ring against the energy dissipation ring.

17. The apparatus of claim 16, wherein the loading means further comprises one or more elastic members, coil springs, flat springs, belleville springs, energy storing devices or combinations thereof.

18. The apparatus of claim 17, wherein the loading means provides a force greater than or equal to about 5000 lbs.

19. The apparatus of claim 16, wherein the loading means is one or more belleville springs.

20. The apparatus of claim 1, wherein the relation between the geometry of the first ring and a force $F_N$ that biases the first ring and the energy dissipation ring together may be expressed as:

$$rw \geqq F_N/2\pi PSI_{CRITICAL})$$

where:

r is the radius of the energy dissipation ring;

w is the width of the energy dissipation ring; and $PSI_{CRITICAL}$ is the design normal loading force.

21. The apparatus of claim 1, wherein the energy dissipation ring is sintered.

22. A processing system comprising:

a chamber having an exhaust port;

a device having a housing and a rotating component disposed within said housing; and a energy dissipating coupling disposed between said exhaust port and said housing of said device, said energy dissipating coupling having:

a first ring coupled to said chamber; and an energy dissipation ring disposed proximate said first ring.

23. The processing system of claim 22, wherein the device is a turbomolecular pump.

24. The processing system of claim 22, wherein the energy dissipation ring deforms when said housing of said device rotates in relation to said chamber.

25. The processing system of claim 22, wherein the energy dissipation ring is biased against the first ring or the device.

26. Apparatus for coupling a device to a processing chamber comprising:

a first ring;

a second ring adapted to rotate relative to the first ring; an energy dissipation ring disposed between said first ring and said second ring; and a loading means for urging the second ring against the energy dissipation ring.

27. The apparatus of claim 26, wherein the loading means further comprises one or more elastic members, coil springs, flat springs, belleville springs, energy storing devices or combinations thereof.

28. The apparatus of claim 27, wherein the loading means provides a force greater than or equal to about 5000 lbs.

29. The apparatus of claim 26, wherein the loading means is one or more belleville springs.

30. The apparatus of claim 26, wherein the relation between the geometry of the first ring and a force $F_N$ that biases the first ring and the energy dissipation ring together may be expressed as:

$$rw \geqq F_N/(2\pi PSI_{CRITICAL})$$

where:

r is the radius of the energy dissipation ring;

w is the width of the energy dissipation ring; and $PSI_{CRITICAL}$ is the design normal loading force.

31. The apparatus of claim 26, wherein the energy dissipation ring is sintered.

* * * * *

UNITED STATES PATENT AND TRADEMARK OFFICE

CERTIFICATE OF CORRECTION

PATENT NO. : 6,485,254 B1 
DATED : November 26, 2002
INVENTOR(S) : Matthew Fenton Davis It is certified that error appears in the above-identified patent and that said Letters Patent is hereby corrected as shown below:

Column 2,
Line 55, replace "sectional" with -- exploded --.
Line 57, replace the phrase starting with "sectional view" continuing through to line 58 ending with "coupler." with -- a partial sectional view of the energy dissipating coupler of Fig. 7; --
Line 60, before the paragraph beginning with "To Facilitate", please add:
-- Fig. 9 is another partial sectional view of the energy dissipating coupler of Fig. 7;
Fig. 10 is an exploded partial perspective view of a second ring of the energy dissipating coupler of Fig. 7;
Fig. 11 is an exploded view of another embodiment of an energy dissipating coupler;
Fig. 12 is a partial sectional view of the energy dissipating coupler of Fig. 11;
Fig. 13 is another partial sectional view of the energy dissipating coupler of Fig. 11; and
Fig. 14 is another partial sectional view of the energy dissipating coupler of Fig. 11. --

Column 3,
Line 54, replace "optionally," with -- Optionally, --.

Column 6,
Line 64, replace "$\mu t_c$" with -- "$\mu/t_c$ --

Column 9,
Line 49, replace "$F_B = F_N$" with -- $F_B = F_N/\mu$ --

Column 10,
Line 18, replace "PSI $_{CRITICAL} \geq F_N/2rw$" with -- PSI $_{CRITICAL} \geq F_N/2\pi rw$ --

Signed and Sealed this

Thirteenth Day of May, 2003

JAMES E. ROGAN
*Director of the United States Patent and Trademark Office*